US008590203B1

(12) United States Patent
McCarthy et al.

(10) Patent No.: US 8,590,203 B1
(45) Date of Patent: Nov. 26, 2013

(54) MAGAZINE WELL INSERT

(76) Inventors: Michael Kevin McCarthy, Enterprise, AL (US); John Irwin McCarthy, Waretown, NJ (US)

( * ) Notice: Subject to any disclaimer, the term of this patent is extended or adjusted under 35 U.S.C. 154(b) by 0 days.

(21) Appl. No.: 13/316,213

(22) Filed: Dec. 9, 2011

(51) Int. Cl.
*F41A 35/02* (2006.01)
*F41A 9/65* (2006.01)

(52) U.S. Cl.
USPC ..... 42/96; 42/50

(58) Field of Classification Search
USPC ..... 42/49.01, 49.02, 50, 96
See application file for complete search history.

(56) References Cited

U.S. PATENT DOCUMENTS

| | | | | |
|---|---|---|---|---|
| 1,015,490 | A * | 1/1912 | Harrington | 42/7 |
| 4,343,107 | A * | 8/1982 | Kaltenegger | 42/7 |
| 4,528,765 | A | 7/1985 | Johnson | |
| 4,862,619 | A * | 9/1989 | Baldus et al. | 42/7 |
| 5,293,708 | A * | 3/1994 | Strayer et al. | 42/75.03 |
| 5,526,600 | A * | 6/1996 | Chesnut et al. | 42/50 |
| 5,584,136 | A * | 12/1996 | Boland et al. | 42/7 |
| 6,557,287 | B2 * | 5/2003 | Wollmann | 42/50 |
| 6,928,764 | B2 * | 8/2005 | Freed | 42/71.02 |
| 7,117,622 | B2 * | 10/2006 | Freed et al. | 42/7 |
| 7,191,556 | B2 * | 3/2007 | Pikielny | 42/7 |
| 2010/0281737 | A1 * | 11/2010 | Cahill | 42/50 |
| 2010/0281748 | A1 * | 11/2010 | Parry et al. | 42/96 |

* cited by examiner

*Primary Examiner* — Bret Hayes
(74) *Attorney, Agent, or Firm* — Lyman H. Smith

(57) ABSTRACT

A magazine well insert prevents contaminants from entering the magazine well of a pistol or a rifle. The magazine well insert provides a visual indication that the weapon does not have a magazine installed, thereby enhancing weapons safety. The magazine well insert of the present invention protects the weapon's magazine well from becoming contaminated with sand and other debris by sealing the magazine well with a block, for example, a plastic or metal block, that has an o-ring or other sealing device adapted to be positioned at the opening of the magazine well. The magazine well insert may be used in two different configurations, a first configuration that allow normal operation of the weapon's action or a second configuration that blocks the action of the weapon. The magazine well insert may be hollow with a removable sliding base to provide for storage in an interior portion thereof.

17 Claims, 10 Drawing Sheets

MAGAZINE WELL INSERT

BACKGROUND OF THE INVENTION

The present invention relates to weapon accessories and, more particularly, to a magazine well insert that prevents contaminants from entering the magazine well on semiautomatic and automatic pistols and rifles. The invention can also be rapidly configured into a weapon safety device by physically preventing the weapons firing pin from coming into contact with a chambered round.

Currently, military personnel deployed in a combat zone must carry a weapon at all times. There are times when military and contract personnel operating inside a secure base or forward operating base must carry a weapon in an unloaded condition with the magazine removed for safety concerns. When the weapons magazine is removed, contaminants, such as dust, sand and other debris, may enter the magazine well contaminating the weapons internal components. This contamination will cause the weapon to malfunction or render the weapon unusable until cleaned.

A common solution currently utilized by United States military personnel for keeping the magazine well on a weapon clean is to place a paper towel or rag in the magazine well. This method of placing a paper product or rag in the weapon's magazine well may allow sand and other debris to bypass the rag or paper product and contaminate the weapon. When deployed in a combat environment, a contaminated weapon may not function properly and could place military personnel in a very dangerous situation. This invention will also benefit all facets of law enforcement. Some police departments do not allow the storage of weapons with a magazine installed and like with the military this causes contamination issues.

Currently, there is an extreme need for a magazine well insert that will protect the weapon from sand, dust and other debris when the weapons magazine is removed from the weapon.

SUMMARY OF THE INVENTION

In one aspect of the present invention, a magazine well insert comprises a main housing adapted to fit into a magazine well of a weapon; and a sealing member spanning a periphery of a lower end of the main housing.

In another aspect of the present invention, a magazine well insert comprises a main housing adapted to fit into a magazine well of a weapon; a reversible top cover fitting over a top end of the main housing; a groove disposed about a periphery of a lower end of the main housing; and a sealing member disposed in the groove. The sealing member, spanning a periphery of a lower end of the main housing, may prevent contamination from entering the magazine well. The top cover may be disposed in two configurations, a first configuration where the weapons firing action is locked forward in the firing position. With the action locked forward, the sealing member seals the weapons firing chamber from debris. The top cover may be disposed in a second configuration, where the invention serves two functions—the first function is to seal the magazine well and prevent contamination, while the second configuration is a safety device that prevents the weapon from being fired in any circumstance.

In a further aspect of the present invention, a magazine well insert comprises a magazine well insert body; a reversible top cover fitting on a top end of the magazine well insert body; a bottom cover removably fitting on the magazine well insert body; a plurality of tabs disposed along sides of the reversible top cover; and a plurality of slots formed along the top end of the magazine well insert, the plurality of slots configured to receive the plurality of tabs when the reversible top cover is installed on the magazine well insert body, wherein the top cover is reversible between a first position and a second position, the first position permitting normal action of a weapon and the second position resulting in a bolt hold back stop protruding from the top cover, the bolt hold back stop blocking a bolt of the weapon when the magazine well insert is inserted in a magazine well of the weapon.

These and other features, aspects and advantages of the present invention will become better understood with reference to the following drawings, description and claims.

DETAILED DESCRIPTION OF THE INVENTION

Figure 1:
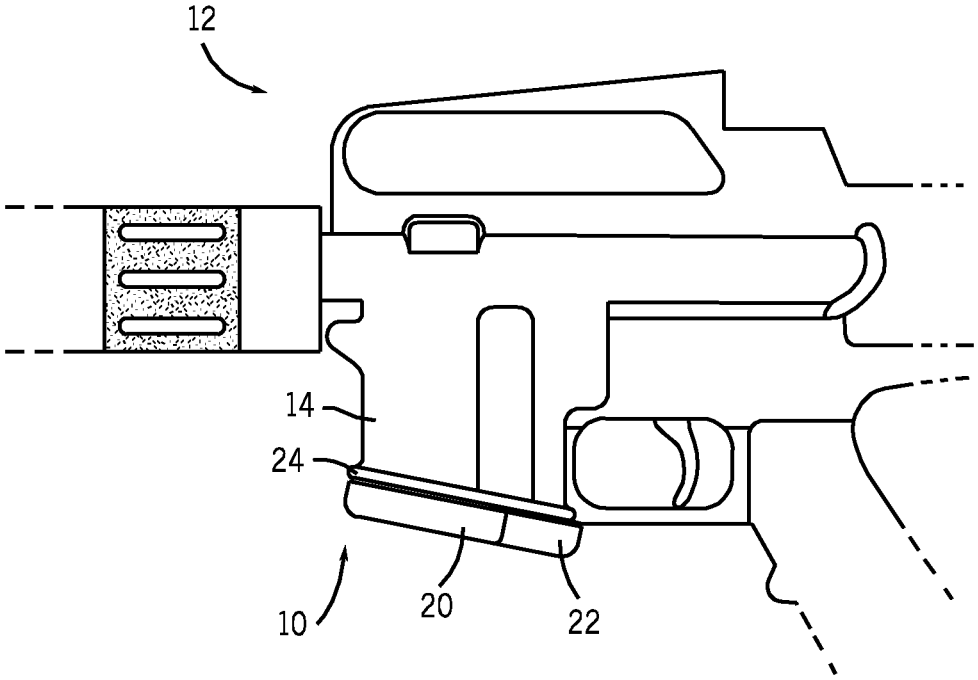
FIG. 1 is a side perspective view of a magazine well insert placed in a long gun (rifle), according to an exemplary embodiment of the present invention.
Figure 2:
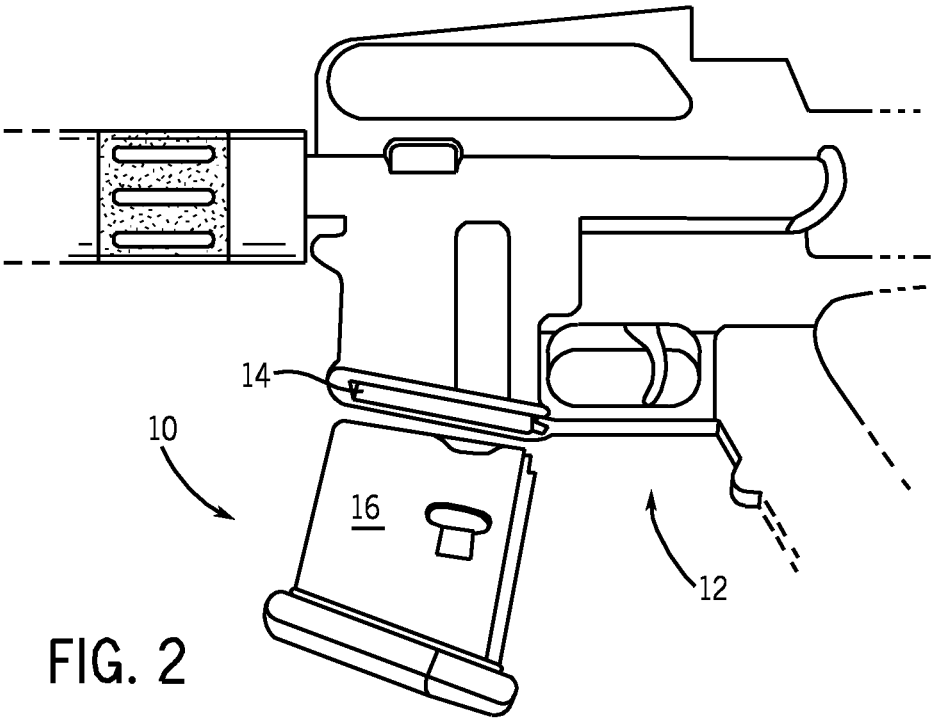
FIG. 2 is an exploded side perspective view of the magazine well insert of FIG. 1 removed from the long gun (rifle)
Figure 2A:
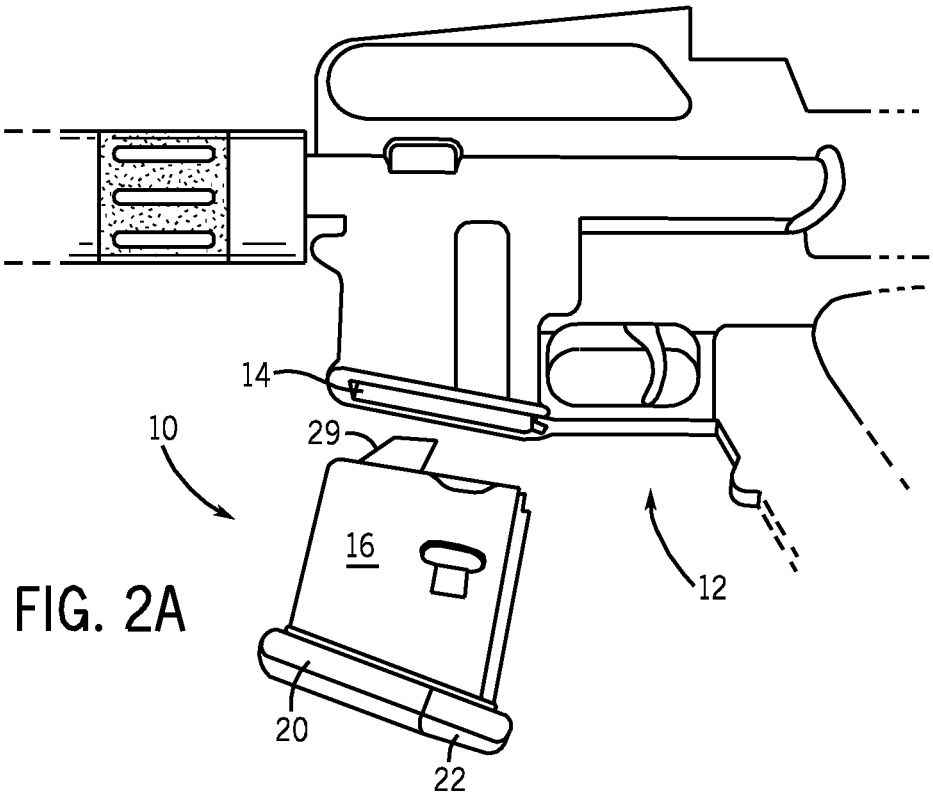
FIG. 2A is an exploded side perspective view of a magazine well insert with the reversible top cover installed with the bolt hold back safety stop exposed when exposed it will not allowing the weapons bolt and firing pin to engage the weapons chamber rendering the rifle in a completely safe status, according to another exemplary embodiment of the present invention, removed from a rifle.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a weapons magazine well insert that prevents contaminants from entering the magazine well of a pistol or a rifle. The magazine well insert provides a visual indication that the weapon does not have a magazine installed, thereby enhancing weapons safety. If the magazine well insert is installed with the weapon's action hold back safety stop positioned in the up position, it will prevent the weapon from being fired, enhancing safety. The magazine well insert of the present invention protects the weapon's magazine well and other internal components from becoming contaminated with sand and other debris by sealing the magazine well with a block, for example, a plastic or metal block, that has an o-ring or similar type seal adapted to be positioned at the opening of the magazine well. The magazine well insert may be used in two different configurations, a first configuration that allow normal operation of the weapon's action or a second configuration that blocks the action of the weapon, the second configuration provides enhanced safety never before offered in a dual function weapons device. The magazine well insert may be hollow with a removable sliding base to provide for storage in an interior portion thereof.

The magazine well insert may engage into the magazine well of a weapon, such as a pistol or a long gun (rifle), in the same manner as an intended magazine. The magazine well insert, however, cannot hold any ammunition, thereby indicating that a magazine is not installed in the weapon, increasing weapons safety. When the magazine well insert is installed, it may seal out sand, dust and other debris by utilizing a sealing member, such as a rubber o-ring or other sealing devices. The magazine well insert may have a unique size and shape permitting the magazine well insert to be used with a M-203 grenade launcher.

Referring to FIGS. 1 through 6, a magazine well insert 10 may be adapted to be installed in a magazine well 14 of a weapon, such as a long gun 12. The magazine well insert 10 may have a main housing 16 forming a generally rectangular cubic shaped member. The shape of the main housing 16 may closely resemble the shape of the magazine (not shown) for that particular long gun (rifle) 12. For example, the main housing 16 may include a magazine well insert retention catch detent 34 and a magazine catch stop ramp 35. A bolt release lever detent 38 may be formed in the rear side of the magazine well insert 10. In some embodiments, the main housing 16 may be hollow. The hollow interior 28 may include reinforcements, such as ribs, to help keep the main housing 16 rigid. In other embodiments, the main housing 16 may be solid.

A top cover 18 may be placed at the top (inserted end) of the main housing 16. In some embodiments (FIGS. 3 and 3A, for example), the top cover 18 may be permanently affixed on the main housing 16. In other embodiments (FIGS. 5 and 6, for example), the top cover 18 may be removable from the main housing 16. In the latter, the top cover 18 may include one or more protrusions 36 that align with one or more depressions 37 in the main housing 16, thereby securing the top cover 18 onto the main housing 16. A magazine release guide 33 may be cut into the top cover 18 to allow the weapon's magazine release mechanism (not shown) to be pushed out of the way, allowing the magazine well insert 10 to engage into the magazine well 14.

A groove 26 may be cut about a periphery of the magazine well insert 10. The groove 26 may be cut into, but not through, the main housing 16, allowing an o-ring 24 to be disposed in the groove 26 and protrude out from a plane of the main housing 16. The o-ring 24 may be, for example, made of nitrile black standard 70 durometer. Other o-ring 24 material may include chloroprene 70 durometer, silicone, polyurethane, felt, rubber, neoprene, BUNA-N, NBR, or the like.

Adjacent to the groove 26, a removable bottom plate 20 may be removable and attached to the main housing 16. The removable bottom plate 20 may be removable from the main housing 16 by sliding the bottom plate 20 along a lip formed in the main housing 16. The bottom plate 20 may permit access to the hollow interior 28 of the main housing 16. A fixed bottom plate 22 may be positioned over a portion of the bottom of the main housing 16. The fixed bottom plate 22 may abut against the bottom plate 20 when the magazine well insert is assembled.

Figure 3:
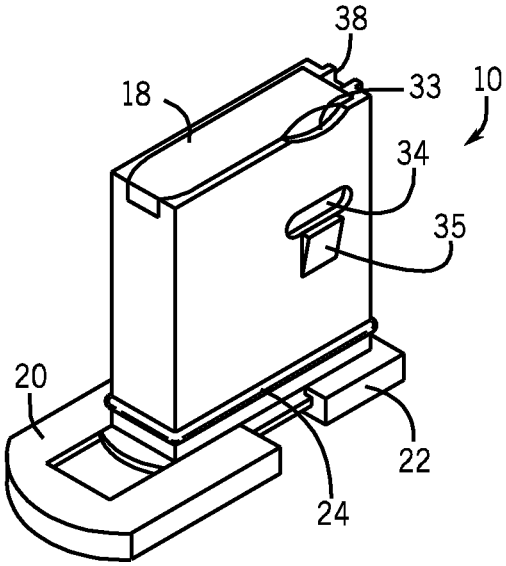
FIG. 3 is a perspective view of the magazine well insert of FIG. 2 with the reversible or fixed flat top cover that would allow the bolt and firing pin to lock into the weapons firing chamber.
Figure 3A:
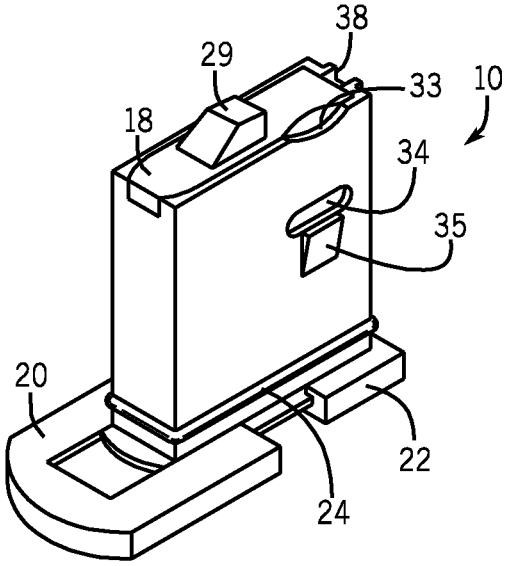
FIG. 3A is a perspective view of the magazine well insert of FIG. 2A with the reversible or fixed top cover having the bolt hold back safety stop in the up position (When placed in this configuration the safety stop will not allow the weapons bolt and firing pin to engage the weapons chamber rendering the rifle in a completely safe status.)
Figure 4:
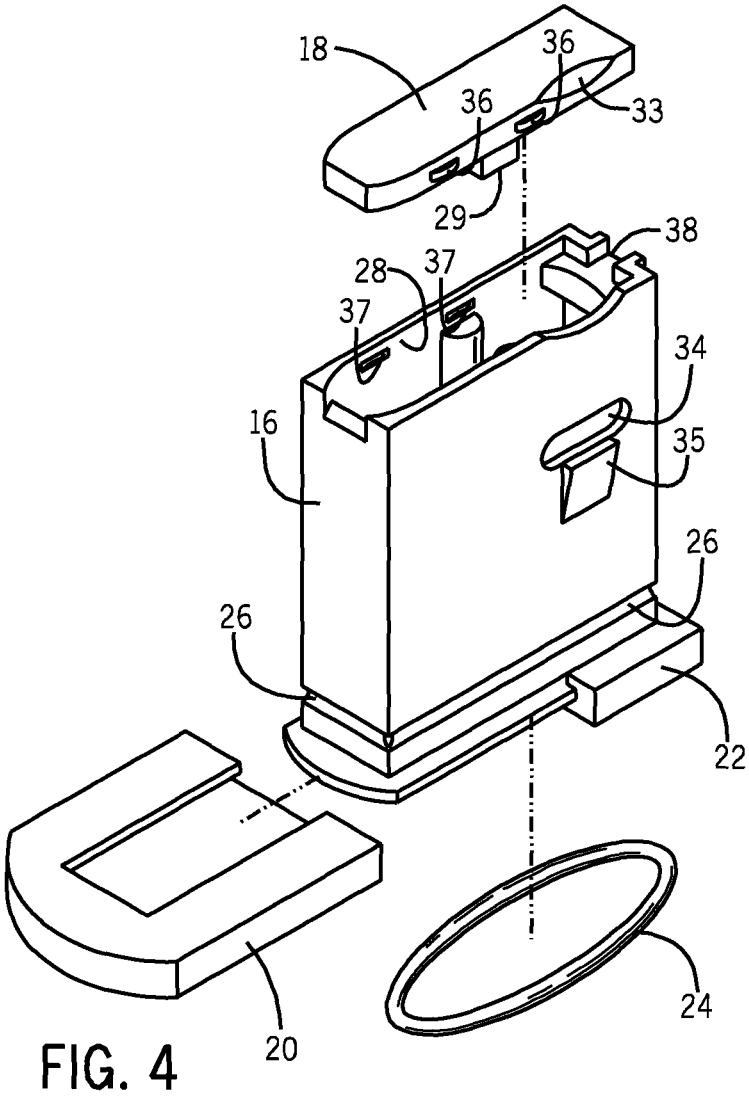
FIG. 4 is an exploded view of the magazine well insert with a reversible top cover.
Figure 4A:
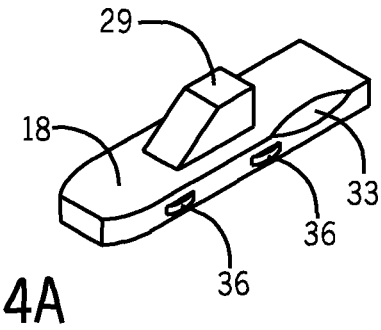
FIG. 4A is a perspective view of the reversible top cover with the bolt hold back safety stop in the up position.

The top cover 18 may include a bolt hold back stop 29. When present, the bolt hold back stop 29 may prevent the action of the bolt, providing a further safety feature to the magazine well insert 10. In some embodiments, the top cover 18 may be permanently affixed to the main housing 16 and may or may not include the bolt hold back stop 29 (as shown in FIGS. 3 and 3A). In other embodiments, the top cover 18 may be removable and may include the bolt hold back stop 29 on one side thereof (see FIG. 4). In this embodiment, the top cover 18 may be placed on the main housing 16 in a first configuration, with a flat top cover 18 (see FIG. 3) or in a second configuration, with the bolt hold back stop 29 protruding from the top cover 18 (see FIG. 3A).

Figure 5:
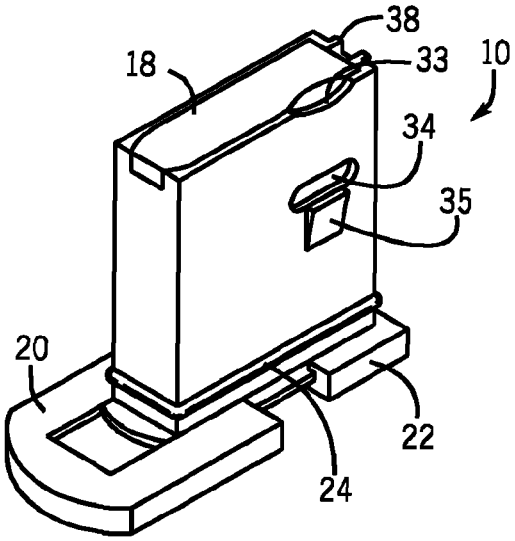
FIG. 5 is a perspective view of the magazine well insert of FIG. 4, with a reversible or fixed top cover in a flat top cover configuration (This position allows the bolt carrier group and firing pin to fully engage into the weapons firing chamber. With the bolt locked into chamber it helps to prevents contamination of the chamber.)
Figure 5A:
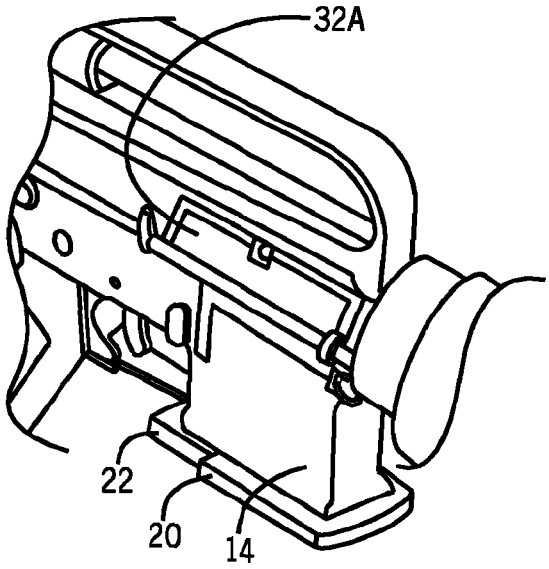
FIG. 5A is a perspective view of the long gun (rifle) shown in FIG. 2 with the invention, the magazine well insert installed in the magazine well of the rifle, the figure also shows the rifles dust cover in the closed position.
Figure 5B:
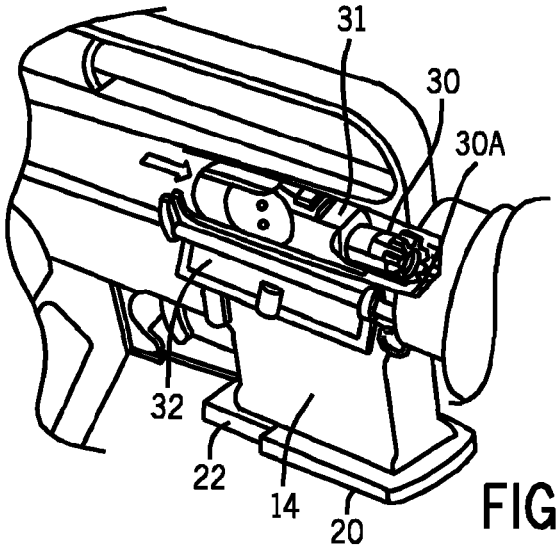
FIG. 5B is a perspective view of the long gun (rifle) shown in FIG. 2 with the dust cover opened and the weapons bolt carrier and bolt assembly locked into the weapons firing chamber, this view show that with the top cover in the flat position, the bolt carrier and bolt assembly can pass over the invention and lock into the firing chamber locking out all sand, dust and debris from the weapon.
Figure 6:
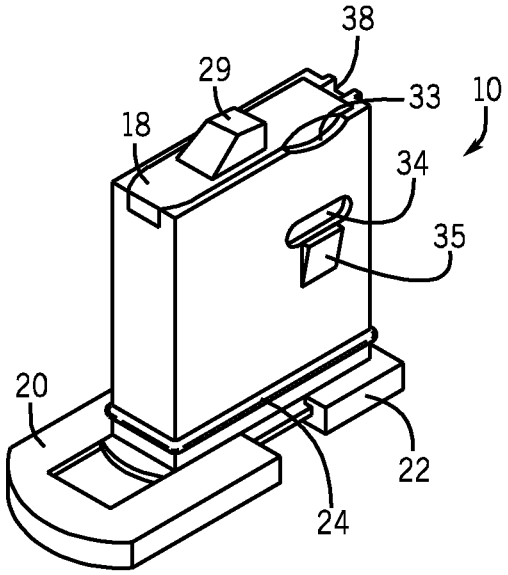
FIG. 6 is a perspective view of the magazine well insert with the sliding storage bottom partially open with a reversible top cover or fixed top cover placed with the bolt hold back safety stop in the up position.
Figure 6A:
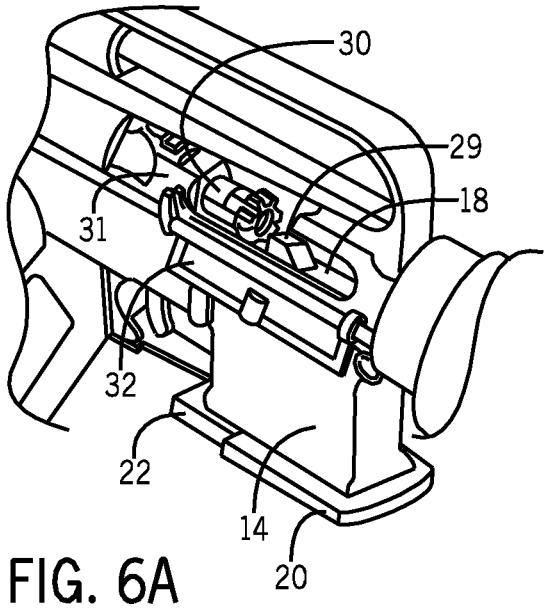
FIG. 6A is a perspective view of the long gun (rifle) shown in FIG. 2A, with the dust cover in the down position and the weapons bolt and bolt carries assembly stopped and resting upon the bolt hold back safety stop in the up position.

When installed in the long gun (rifle) 12 with the top cover 18 in the first, flat top configuration of FIGS. 3 and 5 (see FIG. 5B), the closed dust cover 32A may be moved to an open position 32 to show the bolt chamber 30A of the long gun (rifle) 12. In this configuration, the bolt 30 may be free to move within the bolt chamber 30A. When installed in the long gun (rifle) 12 with the top cover 18 in the second, bolt blocking configuration of FIG. 3A and FIG. 6, the bolt 30 may be blocked by the bolt hold back stop 29. In some embodiments, the bolt hold back stop 29 may be color coded so that it can be readily acknowledged when the weapon is in the bolt blocking configuration.

Figure 7:
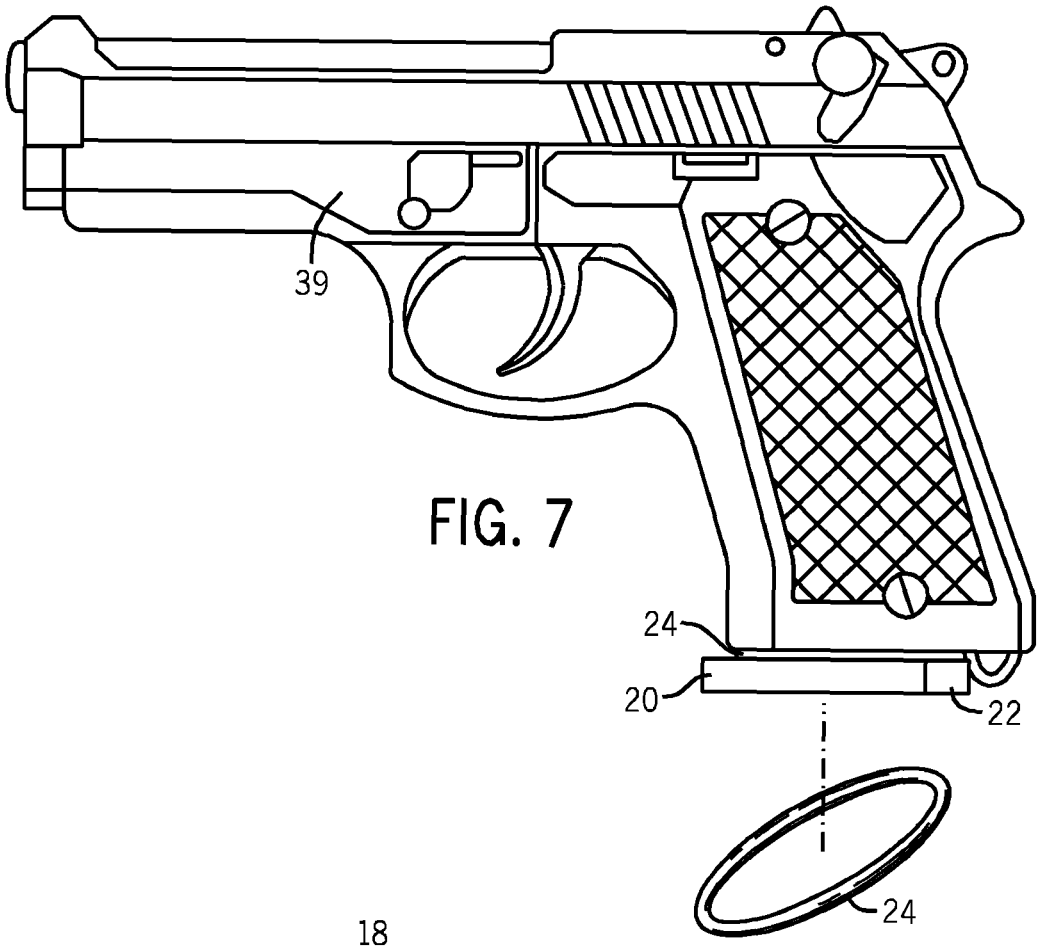
FIG. 7 is a perspective view of a magazine well insert placed in a pistol, according to an exemplary embodiment of the present invention.
Figure 7A:
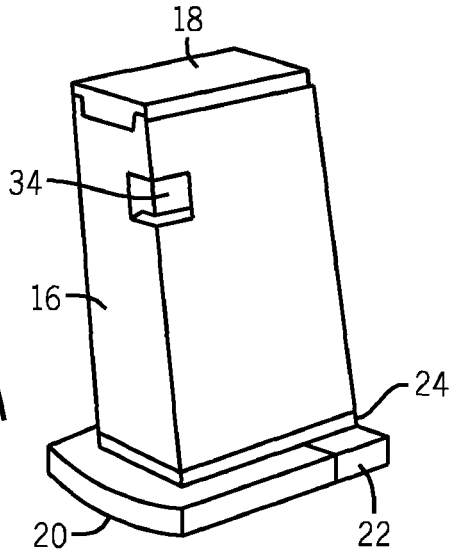
FIG. 7A is a perspective view of the magazine well insert of FIG. 7.
Figure 8:
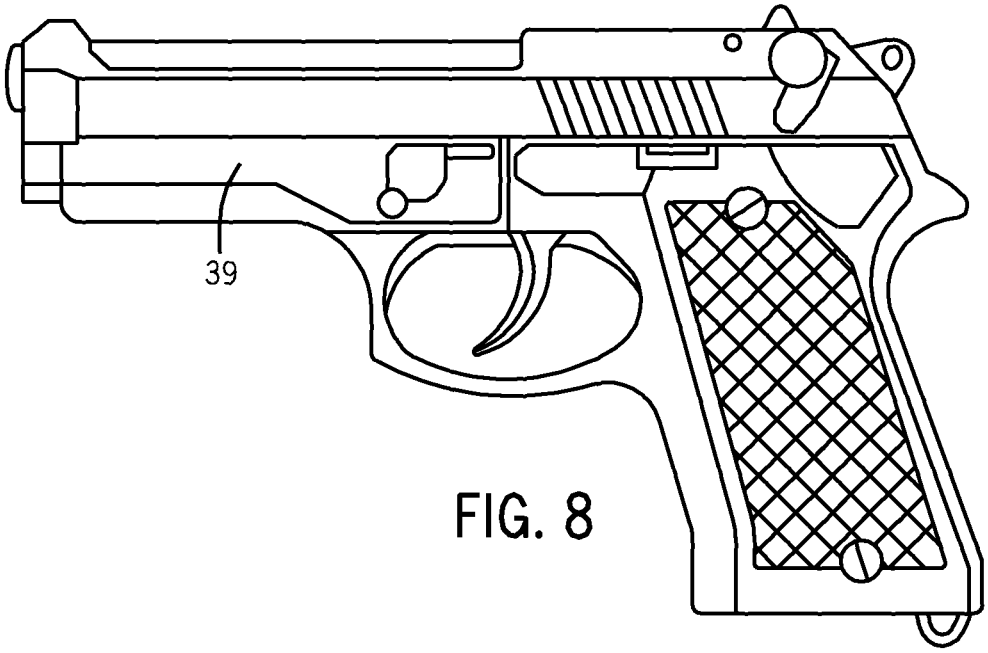
FIG. 8 is a perspective view of a pistol.
Figure 8A:
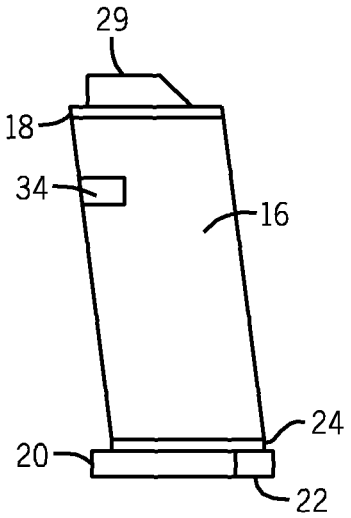
FIG. 8A is a perspective view of the magazine well insert of FIG. 7 with a fixed or reversible weapons action hold back safety stop positioned in the up position, preventing the weapon from being fired enhancing safety.
Figure 8B:
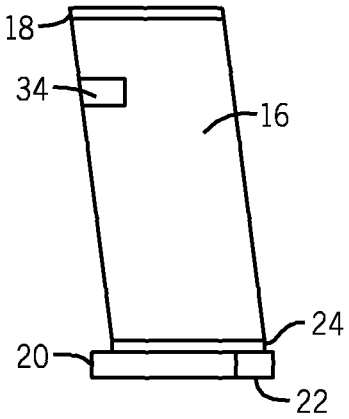
FIG. 8B is a perspective view of the magazine well insert of FIG. 7 with the flat. position that allows the hand gun (pistol) action and firing pin to fully engage into the weapons firing chamber. With the pistols action locked into chamber it prevents contamination of the firing chamber providing the operator with a reliable pistol.
Figure 9A:
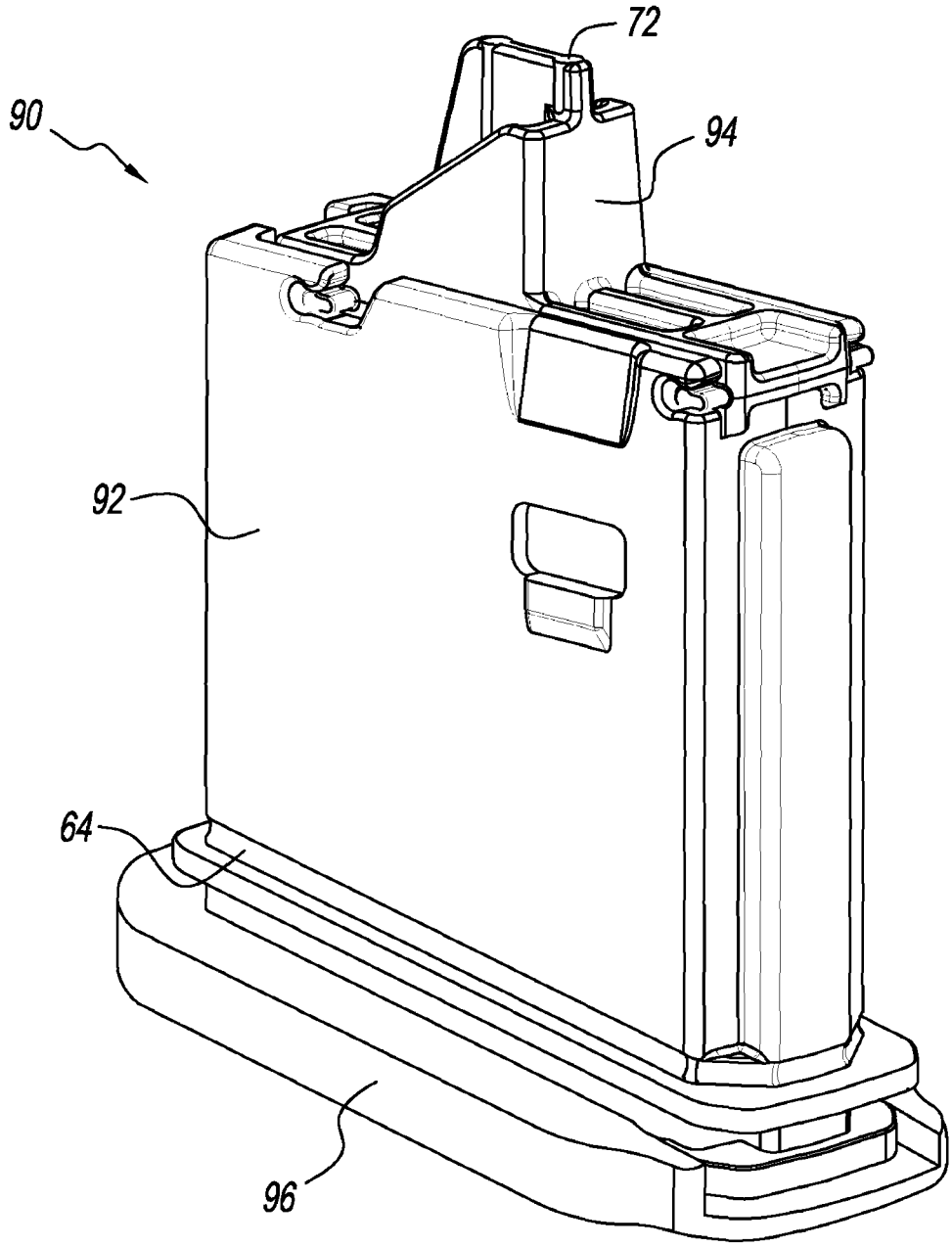
FIG. 9A is a perspective view of a magazine well insert with a reversible top and bottom cover according to an exemplary embodiment of the present invention.
Figure 9B:
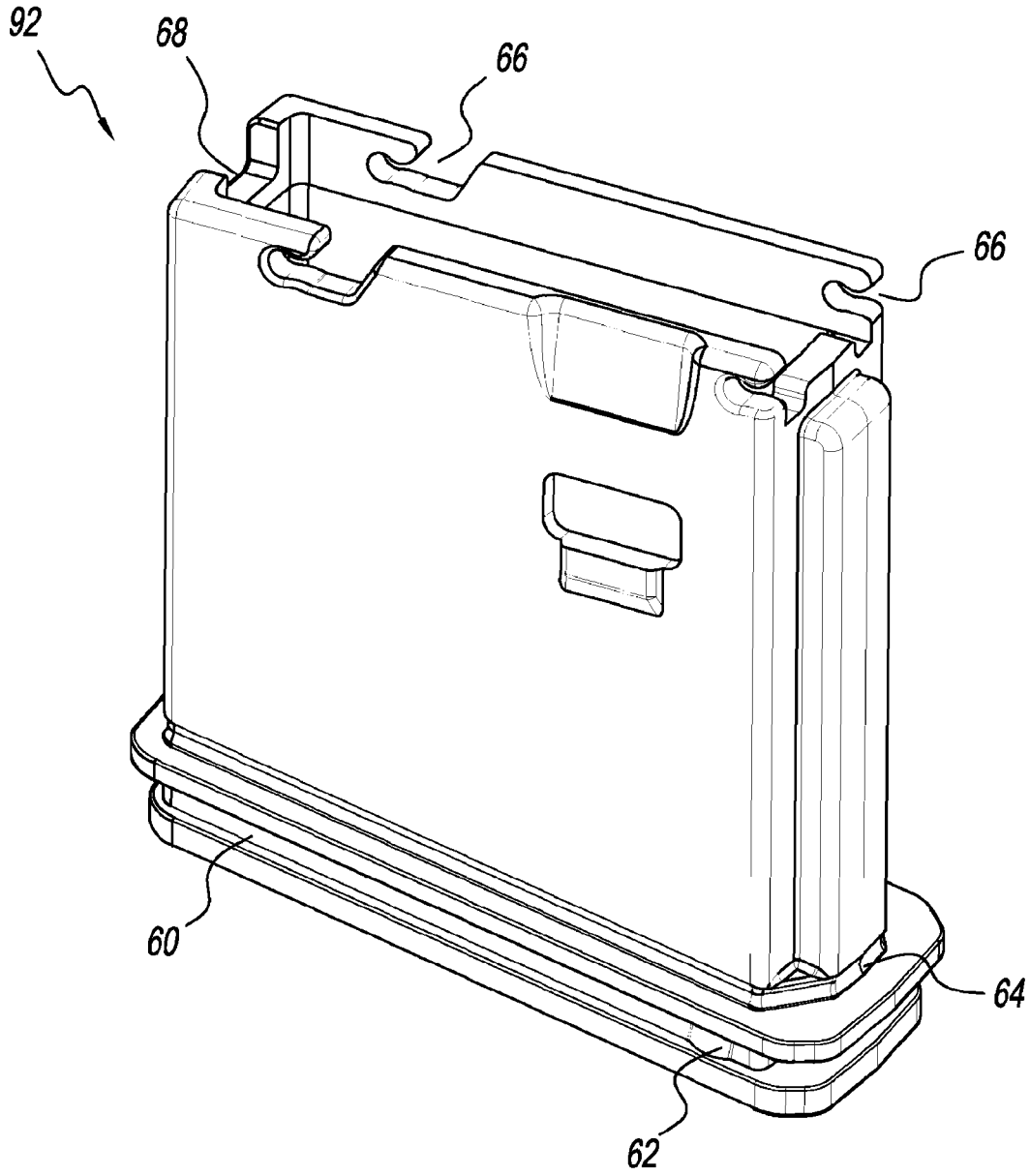
FIG. 9B is a perspective view of a magazine well insert body of the magazine well insert of FIG. 9A.
Figure 9C:
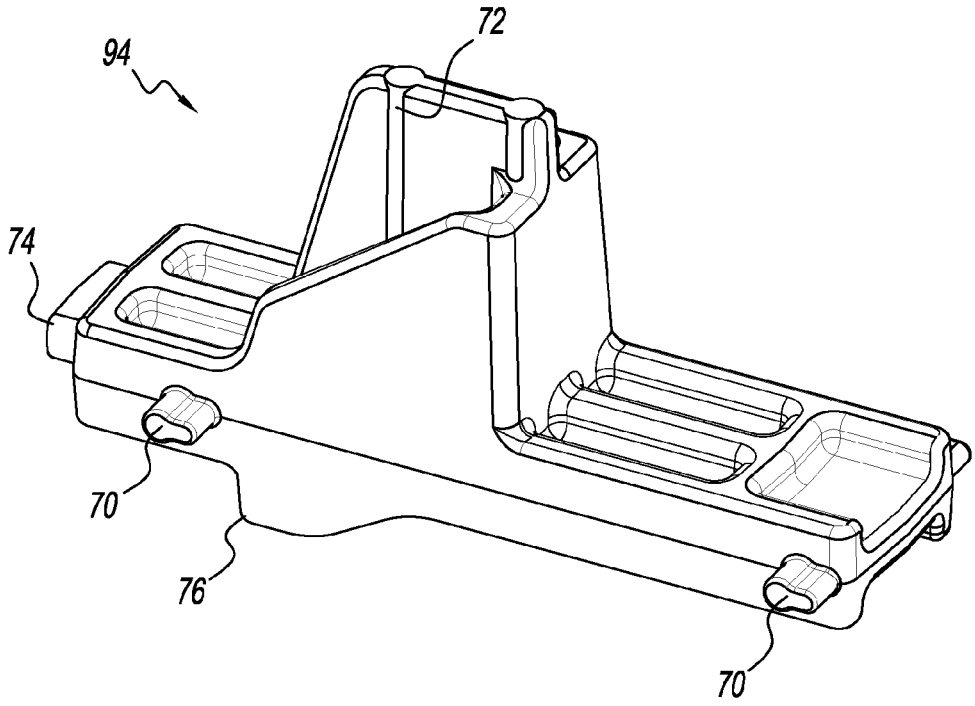
FIG. 9C is a perspective view of a reversible magazine well insert top cover of the magazine well insert of FIG. 9A.
Figure 9D:
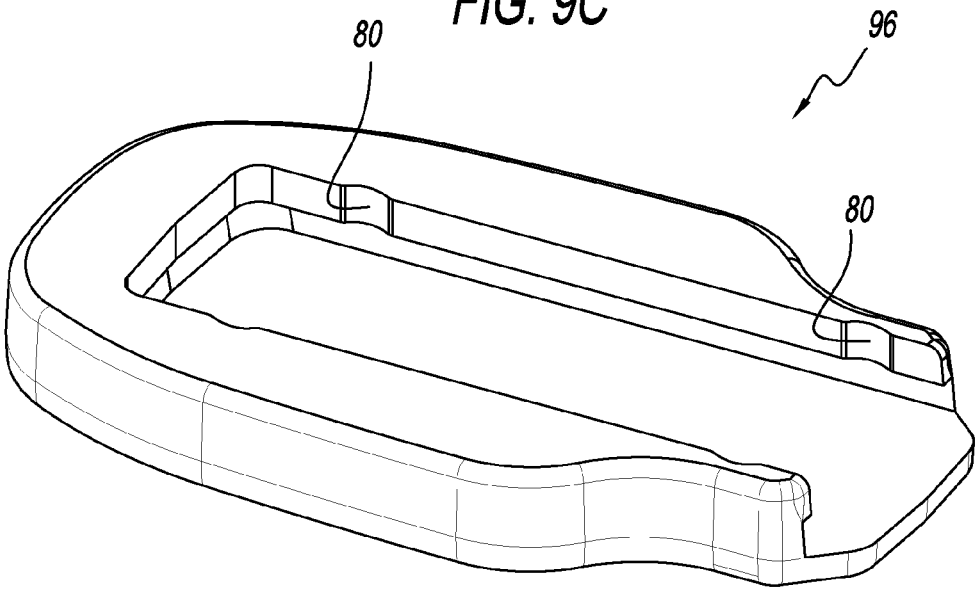
FIG. 9D is a perspective view of a reversible magazine well insert bottom cover of the magazine well insert of FIG. 9A.

Referring now to FIGS. 7 through 8B, a pistol 39 may be protected with a similarly designed magazine well insert, as shown in FIG. 7A. The pistol magazine well insert may be designed similar to that described above with reference to the long gun (rifle) 12. For example, as shown in FIGS. 8A and 8B, the pistol magazine well insert may be configured with the bolt hold back stop 29. In some embodiments, the top cover 18 may be reversible to provide both embodiments (FIGS. 8A and 8B) in a single device.

Referring now to FIGS. 9A through 9D, a specific exemplary embodiment of a magazine well insert 90 is shown. The magazine well insert 90 may include a magazine well insert body 92, a reversible top cover 94 and a bottom cover 96. The magazine well insert body 92 may include a channel 60 for receiving the bottom cover 96. The magazine well insert body 92 may including a sealing member 64, similar to the sealing member described above, adapted to keep dirt, dust, sand and the like, out of the magazine well when the magazine well insert 90 is inserted into a rifle.

The bottom cover 96 may include one or more indents 80 adapted to receive one or more protrusions 62 within the channel 60 in the magazine well insert body 92. In an alternate embodiment, the bottom cover 96 may include a protrusion (not shown) while the channel includes one or more indents (not shown). The bottom cover 96 may slide onto the channel 60 from either end of the magazine well insert body 92. In some embodiments, a channel may be formed in the bottom cover 96 to slide onto the lower end of the magazine well insert body 92. The bottom cover 96 may removably attach to the magazine well insert body 92 in other methods provided that the bottom cover 96 retains items stored in the magazine well insert body 92.

The reversible top cover 94 may removably attach to the magazine well insert body 92. In some embodiments, the reversible top cover 94 may include a plurality of tabs 70 that may fit into slots 66 in the magazine well insert body 92. The tabs 70 may be sized and shaped to fit securely into the slots 66. In some embodiments, two tabs 70 may be disposed on each side of the top cover 94 and two slots may be disposed in the magazine well insert body 92. The top cover 94 may include a tongue member 74 at one end thereof that may fit into a groove 68 at one end of a top side of the magazine well insert body 92.

The tabs 70 may be uniformly distributed about the top cover 94 so that the top cover 94 may be inserted in the magazine well insert body 92 in a first position, with a bolt blocking member 72 pointing away from the magazine insert well body 92, or in a second position, with the bolt blocking member 72 pointing inside of the magazine insert well body 92. In the first position, the bolt blocking member 72 may block the action of a rifle, as described above, when inserted into a magazine well. In some embodiments, at least a portion of the bolt blocking member 72 may be brightly colored to permit it to be clearly visible when looking into the rifle's chamber. In the second position, the action of the rifle may still be active. A gripping tab 76 may be provided to help remove the top cover 94 from the magazine well insert body 92 when in the second position.

The magazine well insert may be made by conventional methods and from conventional materials. For example, the components may be made from injection molded polymer reinforced plastic, stamped metal, milled metal, fiberglass, plastic, Bakelite or other types of composites, or the like. The magazine well insert, and its components, may be sized and shaped according to the weapon for which it is to be designed. For example, the main housing 16 may be about 3 inches long and 1.25 inches wide.

It should be understood, of course, that the foregoing relates to exemplary embodiments of the invention and that modifications may be made without departing from the spirit and scope of the invention as set forth in the following claims.

We claim:

1. A magazine well insert designed for a magazine fed weapon, the magazine well insert comprising:

a main housing adapted to fit into a magazine well of the magazine fed weapon;

a top cover disposed at a top end of the main housing;

a plurality of tabs disposed about a periphery of the top cover;

a plurality of slots adapted to receive the plurality of tabs of the top cover, wherein the tabs and slots are aligned to permit the top cover to fit either a in a first position, with an action blocking member on the top cover adapted to block the action of the weapon, and a second position, with the action blocking member disposed inside of the main housing;

a tongue member extending from one end of the top cover;

a housing slot formed in one end of a top portion of the main housing, wherein the tongue member is adapted to fit into the housing slot when the top cover is installed on the main housing in either the first position or the second position; and a sealing member spanning a periphery of a lower end of the main housing.

2. The magazine well insert of claim 1, further comprising a groove for containing the sealing member.

3. The magazine well insert of claim 1, wherein the sealing member is an o-ring.

4. The magazine well insert of claim 1, further comprising a bottom plate, wherein a rear portion of the bottom plate is fixed on the lower end of the main housing and a front portion of the bottom plate is removable from the main housing.

5. The magazine well insert of claim 1, further comprising a unitary bottom plate, wherein the bottom plate is removable from the main housing.

6. The magazine well insert of claim 1, wherein the main housing is hollow, wherein access to a hollow interior of the main housing is made by removing a removable bottom plate.

7. A magazine well insert comprising:

a magazine well insert body;

a reversible top cover fitting on a top end of the magazine well insert body;

a bottom cover removably fitting on the magazine well insert body;

a tongue member extending from one end of the top cover; and a housing slot formed in one end of a top portion of the main housing, wherein the tongue member is adapted to fit into the housing slot when the top cover is installed on the main housing in either a first position or a second position, the first position permitting normal action of a weapon and the second position resulting in a bolt hold back stop protruding from the top cover, the bolt hold back stop blocking a bolt of the weapon when the magazine well insert is inserted in a magazine well of the weapon;

a plurality of tabs disposed along sides of the reversible top cover; and a plurality of slots formed along the top end of the magazine well insert, the plurality of slots configured to receive the plurality of tabs when the reversible top cover is installed on the magazine well insert body.

8. The magazine well insert of claim 7, wherein two tabs are disposed on each side of the top cover and two slots are disposed in the magazine well insert body.

9. The magazine well insert of claim 7, further comprising a sealing member spanning a periphery of a lower end of the main housing.

10. The magazine well insert of claim 9, further comprising a groove for containing the sealing member.

11. The magazine well insert of claim 9, wherein the sealing member is an o-ring.

12. A magazine well insert designed for a magazine fed weapon, the magazine well insert comprising:

a main housing adapted to fit into a magazine well of the magazine fed weapon;

a top cover disposed at a top end of the main housing;

a plurality of protrusions disposed about a periphery of the top cover;

a plurality of depressions adapted to receive the plurality of protrusions of the top cover, wherein the protrusions and depressions are aligned to permit the top cover to fit either a in a first position, with an action blocking member on the top cover adapted to block the action of the weapon, and a second position, with the action blocking member disposed inside of the main housing;

a tongue member extending from one end of the top cover;

a housing slot formed in one end of a top portion of the main housing, wherein the tongue member is adapted to fit into the housing slot when the top cover is installed on the main housing in either the first position or the second position; and a sealing member spanning a periphery of a lower end of the main housing.

13. The magazine well insert of claim 12, further comprising a groove for containing the sealing member.

14. The magazine well insert of claim 12, wherein the sealing member is an o-ring.

15. The magazine well insert of claim 12, further comprising a bottom plate, wherein a rear portion of the bottom plate is fixed on the lower end of the main housing and a front portion of the bottom plate is removable from the main housing.

16. The magazine well insert of claim 12, further comprising a unitary bottom plate, wherein the bottom plate is removable from the main housing.

17. The magazine well insert of claim 12, wherein the main housing is hollow, wherein access to a hollow interior of the main housing is made by removing a removable bottom plate.

* * * * *